US005649521A

United States Patent [19]

King

[11] Patent Number: 5,649,521

[45] Date of Patent: Jul. 22, 1997

[54] CROSS BOW

[76] Inventor: Franklin H. King, P.O. Box 8303, Coburg, Oreg. 97401

[21] Appl. No.: 437,132

[22] Filed: May 5, 1995

Related U.S. Application Data

[62] Division of Ser. No. 162,634, Dec. 2, 1993, Pat. No. 5,437,260.

[51] Int. Cl.[6] ..... F41B 5/12

[52] U.S. Cl. ..... 124/25

[58] Field of Search ..... 124/24.1, 25

[56] References Cited

U.S. PATENT DOCUMENTS

| | | | |
|---|---|---|---|
| 1,375,990 | 4/1921 | Yorgensen | 124/25 |
| 2,099,957 | 11/1937 | Graham | 124/25 X |
| 2,313,803 | 3/1943 | Carlson | 124/25 |
| 3,538,901 | 11/1970 | Switack | 124/25 |
| 4,697,571 | 10/1987 | Waiser | 124/25 |
| 4,732,134 | 3/1988 | Waiser | 124/25 |
| 5,062,406 | 11/1991 | Robertson | 124/25 |
| 5,119,797 | 6/1992 | Anderson | 124/25 |

FOREIGN PATENT DOCUMENTS

| | | | |
|---|---|---|---|
| 3405463 | 8/1985 | Germany | 124/25 |

*Primary Examiner*—John A. Ricci
*Attorney, Agent, or Firm*—David Fink

[57] ABSTRACT

A crossbow for shooting projectiles includes a frame with flexible bow arms and a bowstring connecting the arms, a trigger assembly for retaining the bowstring in a cocked position and releasing to propel the projectile, and a hollow barrel with interior rifling into which projectiles are loaded and through which they are expelled. A firing bolt is connected to the bowstring and located in the barrel to transfer force from the bowstring to the projectile. In the prior art, such firing bolts contact the barrel interior, resulting in friction and wear of the rifling. In this invention, the barrel includes an elongated slot (317) therealong. The firing bolt (324) is slidably supported on rails (329) on the exterior of the barrel. The firing bolt includes a driving member (338, 327) which extends through the slot to contact the projectile, but does not contact the barrel interior walls, thus propelling the projectile without causing friction and wear within the barrel.

1 Claim, 13 Drawing Sheets

38
37
36
47
48
49
165
120
129
130
246
117
121
121
136
103'
103'
103
103
111
111
106
106'
160
111'
111'
107

CROSS BOW

This is a division of Ser. No. 08/162,634 filed Dec. 2, 1993 now U.S. Pat. No. 5,437,260.

REFERENCE TO CO-PENDING DOCUMENT

Reference is had to co-pending disclosure document 288,597, filed August 1991.

TECHNICAL FIELD

The invention relates to a cross bow and more particularly to a cross bow capable of firing arrows, pellets or balls.

BACKGROUND OF THE INVENTION

The invention relates to a cross bow used by people engaged in hunting and target practice in general. Typically, the cross bow is in the form of a bow mounted on a stock in the general form of a rifle. The string of the bow is drawn back to a cocked position and is locked in that position under the control of the trigger until an arrow is fired. The cross bow allows the use of a relatively higher tension for the string as compared to an ordinary bow because both hands are available for cocking or a mechanical device can be used, and once the string is cocked, it remains cocked until it is discharged. An ordinary bow is drawn with a single hand and can only be maintained in a cocked position by physically holding the string in the cocked position.

Even though both hands can be used to cock a cross bow, the cocking procedure is still challenging because it is necessary to maintain increasing tension on the string continuously from the static position to the cocked position. The distance can be about one foot or more. The last portion is the most difficult for the operator because the tension is the highest and it comes immediately after the physical effort to move the string the first eight or more inches so that the arms may be tired by the time the most difficult portion is reached.

There are complex mechanically arrangements available for assisting in cocking a cross bow. These mechanical systems have many drawbacks besides being complex. Such mechanical systems add greatly to the weight of the cross bow or to the weight of equipment the operator must carry around to use the cross bow.

An improved, less physically demanding method and apparatus for loading a cross bow is needed. Such an apparatus should preferably add very little weight to the cross bow and simplify the operation of cocking for the operator.

Prior art cross bows are designed to fire a single arrow and then require recocking and reloading. That is, the cross bows are "single barrel" or single shot bows. It would be highly advantageous to have a "double barrel" cross bow so that two shots could be fired separately as needed. This is particularly beneficial for game hunting where the first shot misses or slightly wounds the game and the rapid firing of a second round is essential for hitting the game or minimizing the pain the game must endure.

Generally, prior art cross bows are limited to firing arrows. There have been cross bows capable of firing pellets and in some cases both pellets and arrows. In addition to firing pellets and arrows, it would be advantageous to fire balls and even bullets, if desired. There is a need for a cross bow with such a diverse capability.

SUMMARY OF THE INVENTION

The present invention overcomes the disadvantages of the prior art cross bows and provides improvements previously considered outside the scope of operation of a cross bow. In addition, the present invention provides versatility and convenience to the improved cross bow.

As used herein, the term "single barrel" refers to a cross bow which has a single firing system so that it can fire only a single missile at a time.

as used herein, the term "double barrel" refers to a cross bow having two firing systems so that it can fire two missiles sequentially or simultaneously.

It is an object of the present invention to provide a cross bow which is relatively easy to cock without adding any significant weight to the cross bow.

It is another object of the present invention to provide a cross bow which is a "double barrel" cross bow and capable of firing two separate missiles sequentially or simultaneously under the control of the operator.

It is yet another object of the present invention to provide a cross bow which is capable of firing arrows, pellets and balls, selectively.

It is a further object of the present invention to provide a cross bow which is capable of firing balls which are retained and fed into a firing position automatically.

It is yet a further object of the present invention to provide a cross bow including a floating bolt for firing missiles.

Other embodiments, features and advantages of the invention will become apparent upon reading the specification.

DETAILED DESCRIPTION OF THE PREFERRED EMBODIMENTS

Figure 4:
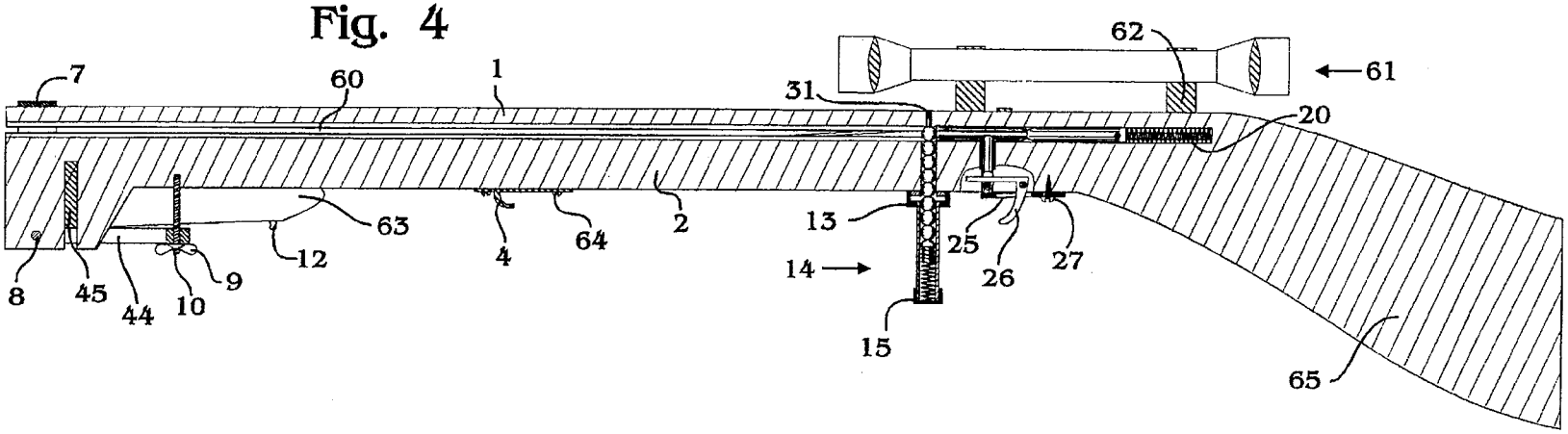
FIG. 4 is a view of the cross bow shown in FIG. 2 along the line 4—4.
Figure 5:
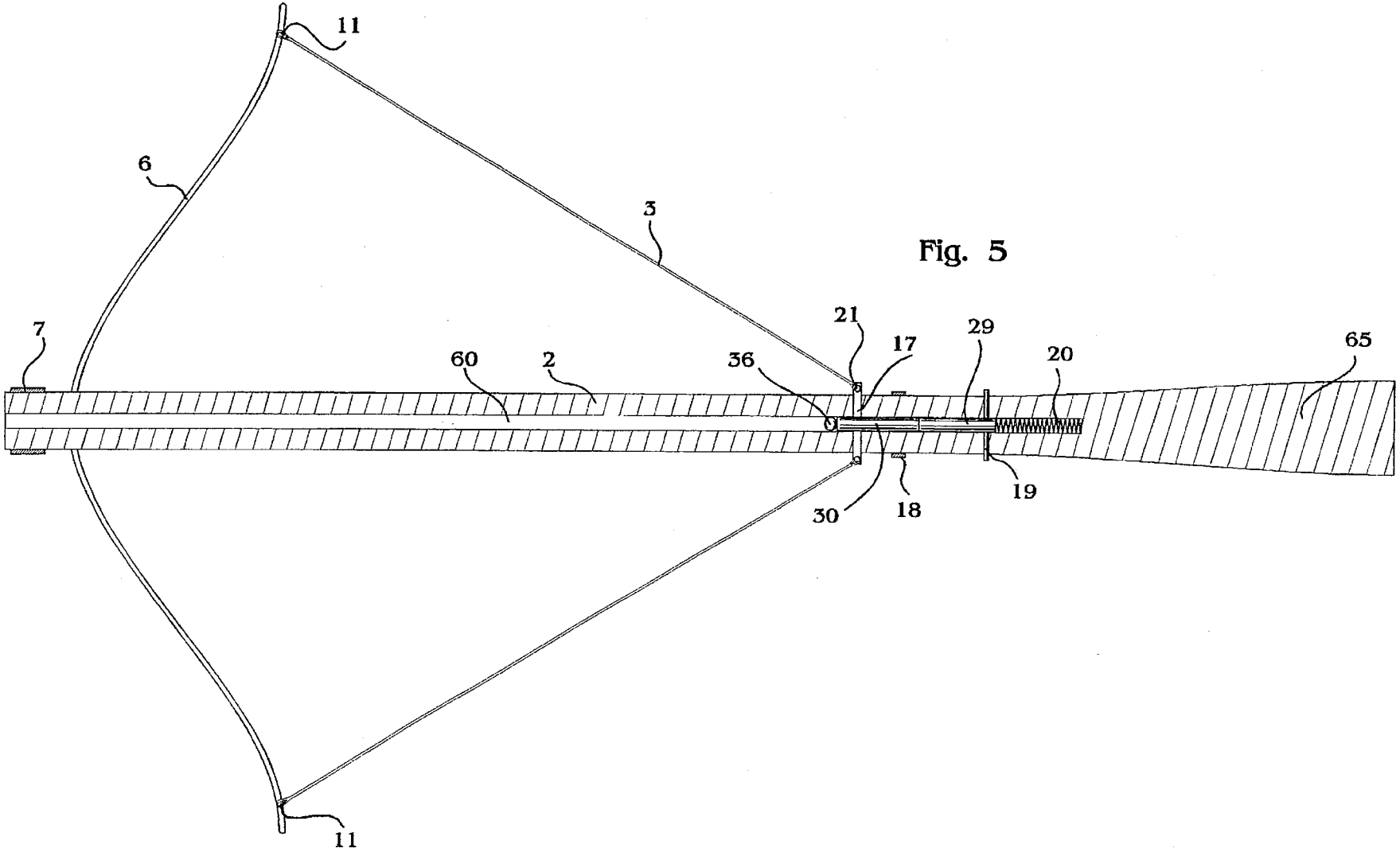
FIG. 5 is a view of the cross bow shown in FIG. 1 along the line 5—5.

FIGS. 1–10 show one of the preferred embodiments of the cross bow according to the invention. A channel 60 is defined between top main beam 1 and bottom main beam 2 as shown in FIG. 4. Cross bar 17 moves within the channel 60 for firing projectiles as shown in FIG. 5. Muzzle bracket 7 serves to maintain the separation of the main beams 1 and 2, and to stop the movement of the cross bar 17 when a projectile is fired. The muzzle bracket 7 is fixed in place with metal pins 8 riveted to bracket 7. Instead of pins 8, threaded bolts not shown) could be used by screwing them into the bracket 7. Stop bar 18 also operates to maintain the relative positions of the main beams 1 and 2 along with other functions which will described later herein.

Bow 6 is positioned in slot 45 as shown in FIG. 4 and bow anchor bar 44 retains the bow 6 in the slot 45. The anchor bar 44 is rotatably attached to the bottom main beam 2 with a nail 8 at one end and attached to the bottom main beam 2 using bolt 10 which is anchored in the bottom main beam 2 and wing nut 9. A telescope 61 mounted on brackets 62 can be used for increased accuracy. Butt 65 can have a shape in accordance with well known designs.

Figure 2:
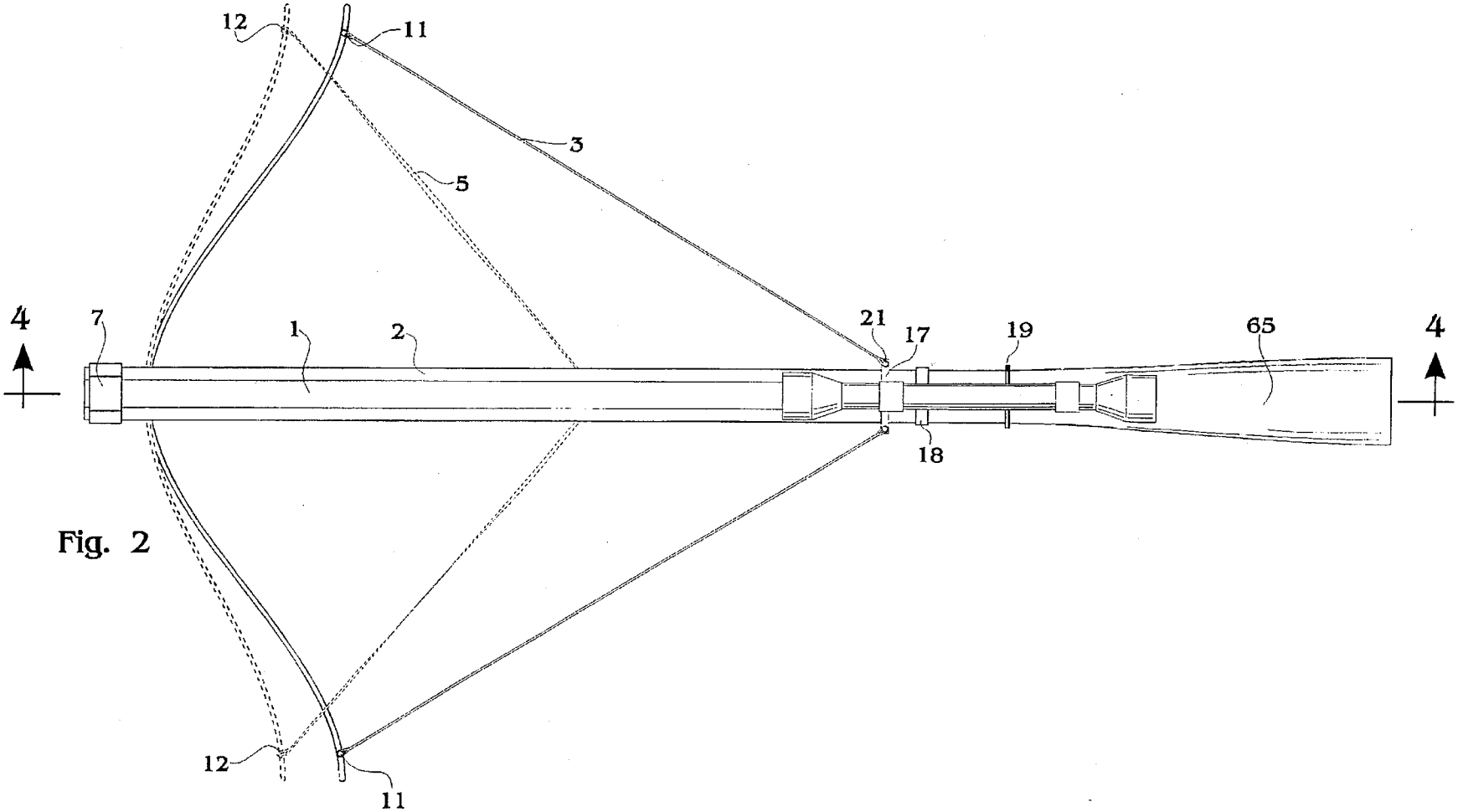
FIG. 2 is a top plan view of the cross bow shown in FIG. 1 with the change that the semi-cocked position is shown in dotted lines.

A main string 3 which is in two parts is attached to the bow 6 at respective horns 11 and the other ends of the string 3 are attached to cross bar horns 21 on the cross bar 17 as shown in FIG. 2. Preferably, the ends of the string 3 attached to the horns 11 have loops for engaging the horns 11 and allowing the easy removal from the horns 11. The stop bar 18 limits the movement of the cross bar 17 so that after reaching a cocked position, there is little additional movement of the cross bar 17.

Figure 1:
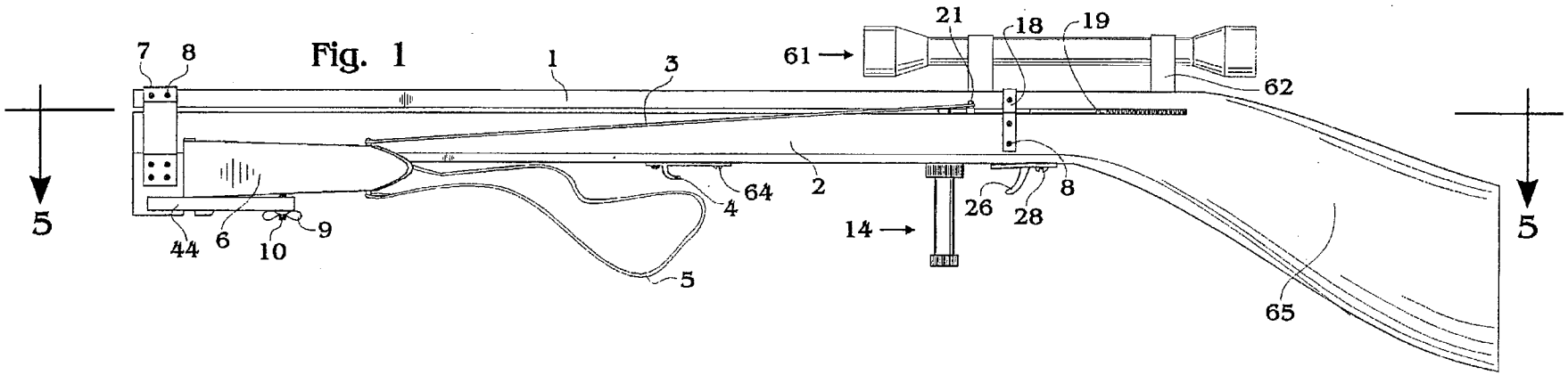
FIG. 1 is a side elevational view of one embodiment of the cross bow according to the invention for a "single barrel" cross bow in its cocked position.
Figure 3:
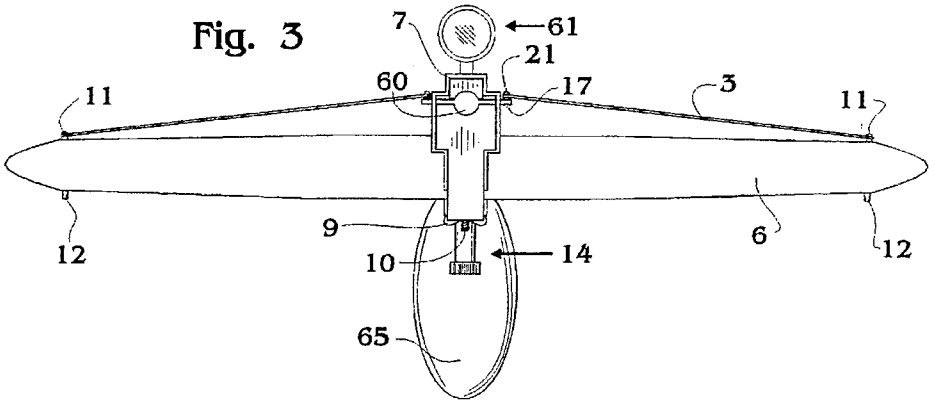
FIG. 3 is a front end elevation view of the cross bow shown in FIG. 1.

Cocking of the cross bow shown in FIG. 1 is greatly simplified by the use of a loading string 5. Ends of the loading string 5 are attached to respective bottom bow horns 12. The ends of the string 5 are preferably formed in loops to allow easy attachment and removal from the horns 12. A hook 4 is mounted on the bottom main beam 2 with screws 64 and is positioned to receive the loading string 5 as shown in dotted lines in FIG. 2.

For cocking the cross bow shown in FIG. 4, initially the loading string 5 is pulled back and the loading string 5 is engaged with the hook 4. This results in the bow 6 being bent as shown in dotted lines in FIG. 2 in a half cocked state. Thereafter, the cocking is completed by moving the cross bar 17 further back to engage the trigger mechanism which will be described in more detail hereinafter.

Figure 6:
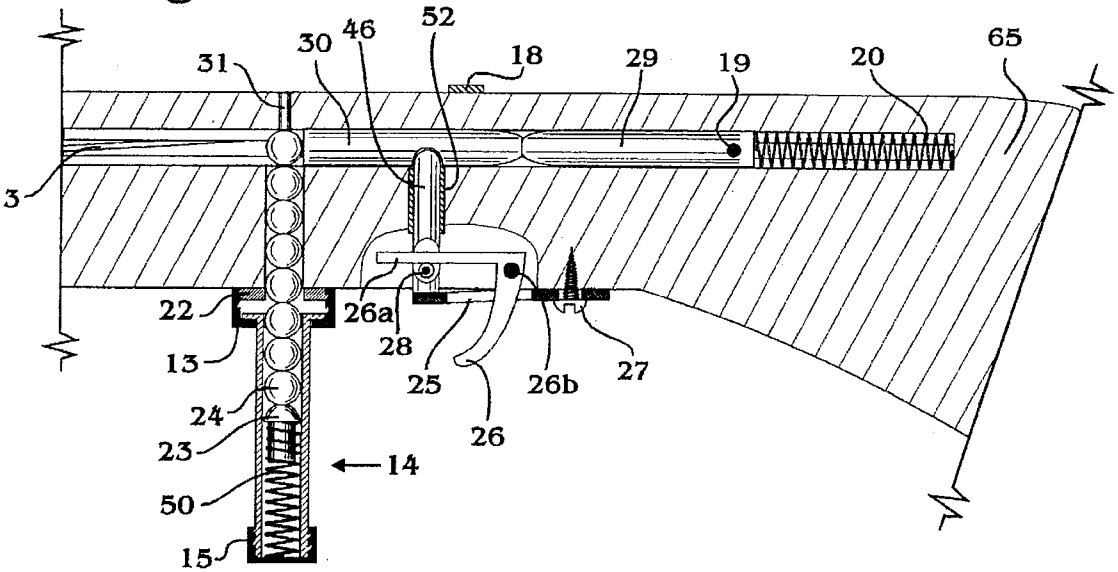
FIG. 6 is an enlarged fragmentary view of a portion of the cross bow shown in FIG. 4 in order to show details in the operation of the triggering system and the missile ball system.

The trigger mechanism is shown in detail in FIGS. 5 and 6. The cross bar 17 is connected to firing bolt 30 which actually engages missiles such as ball 36 for pushing out of the cross bow, that is, for firing. When the cross bar 17 is moved into a cocked position, the firing bolt 30 is moved to a position for cocking bolt 46 to engage it as shown in FIG. 6. The cocking bolt 46 is urged upward by cocking spring 25 which is in the form of a flat spring. The cocking bolt 46 moves within a sleeve 52. One end of the cocking spring 25 is fixed into the bottom main beam 2 with a screw 27. Trigger 26 is positioned in an opening in the cocking spring 25 and includes an arm 26a contacting locking plunger pin 28 in the cocking bolt 46. The trigger 26 is rotatably mounted on pin **26*b* so that movement of the trigger 26 towards the butt 65 results in the arm 26*a* pushing the cocking bolt 46 down, thereby releasing the firing pin 30 to propel a missile such as the ball 36**.

Figure 7:
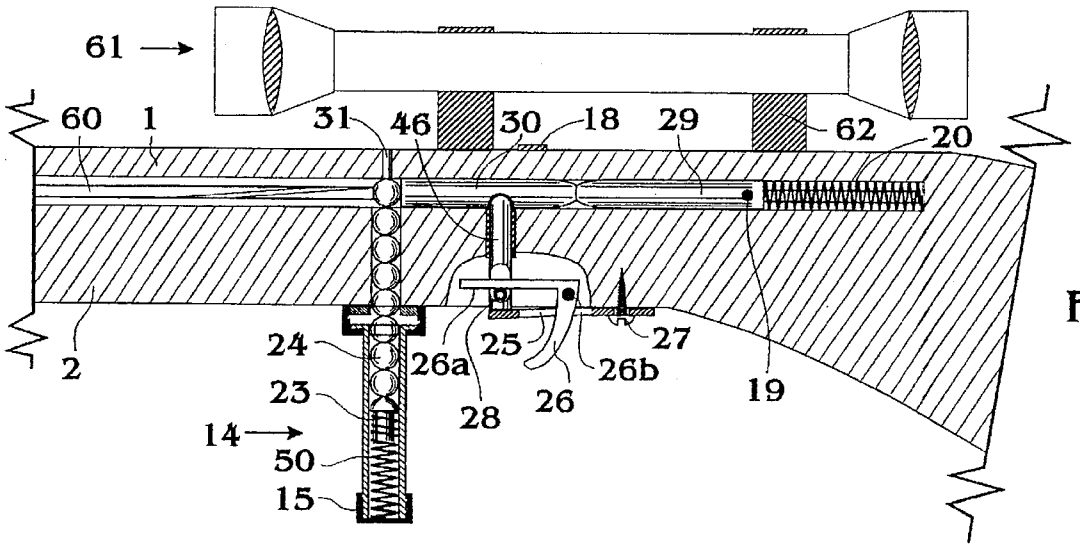
FIGS. 7–10 are enlarged fragmentary views of the cross bow shown in FIG. 4 and show the changes in components during the sequence of firing a missile from the cross bow.

FIGS. 7–10 show the operation of the trigger mechanism in detail and at different stages of firing the ball 36. In addition, FIGS. 7–10 shows the feeding system for the balls 36 into the firing position. FIG. 7 shows the firing bolt 30 engaged by the cocking bolt 46. A magnet 31 can be used for holding the ball 36 made of a suitable material such as steel in its firing position so that the ball 36 does not roll down the channel 60 accidentally. Balls 24 are stored and fed from a magazine 14. The balls 24 are urged upwards by magazine bolt 23 which is connected to clip magazine spring 50. The magazine 14 is screwed into threaded sleeve head 22 in the magazine locking cap 13 on the bottom main beam 2 as can be seen in FIG. 6. The top of the magazine bolt 23 is rounded and the full expansion of the spring 50 extends the magazine bolt 23 so that the rounded end of the magazine bolt 23 extends slightly into the channel 60 when there are no other balls 24 left. This allows delivery of the last ball 24 and also allows the firing bolt 30 and free float bolt 29 to move over the magazine bolt 23 when other missiles are being fired. The free float bolt 29 is urged against the firing bolt 30 by spring 20 which is attached to the free float bolt 29 by pin 19.

Figure 8:
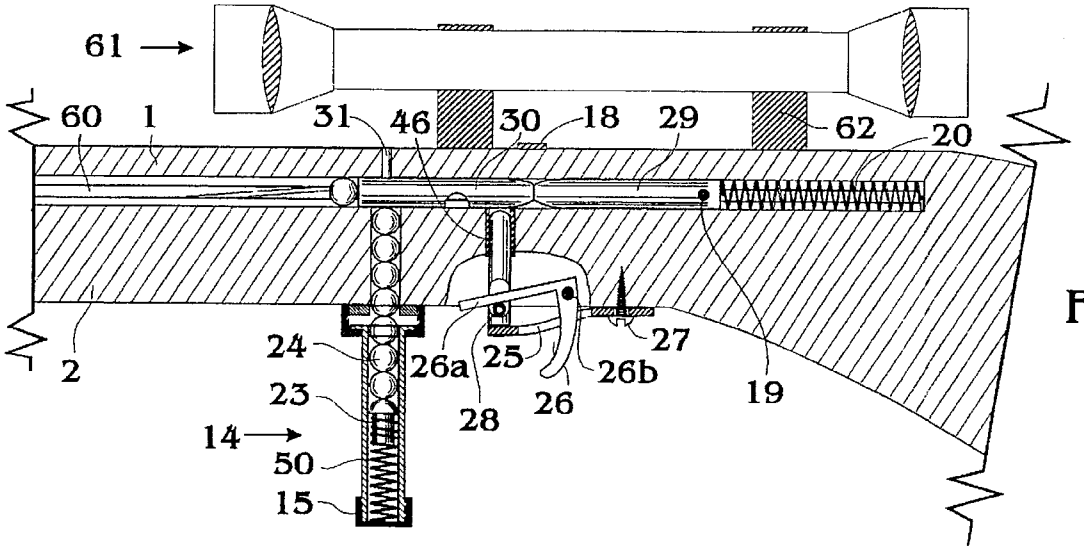
Figure 9:
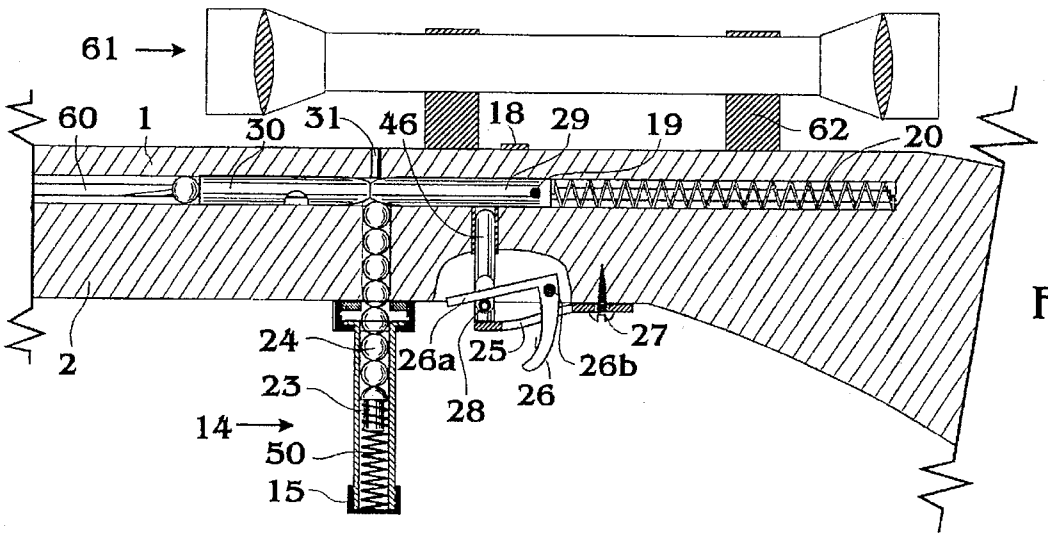
Figure 10:
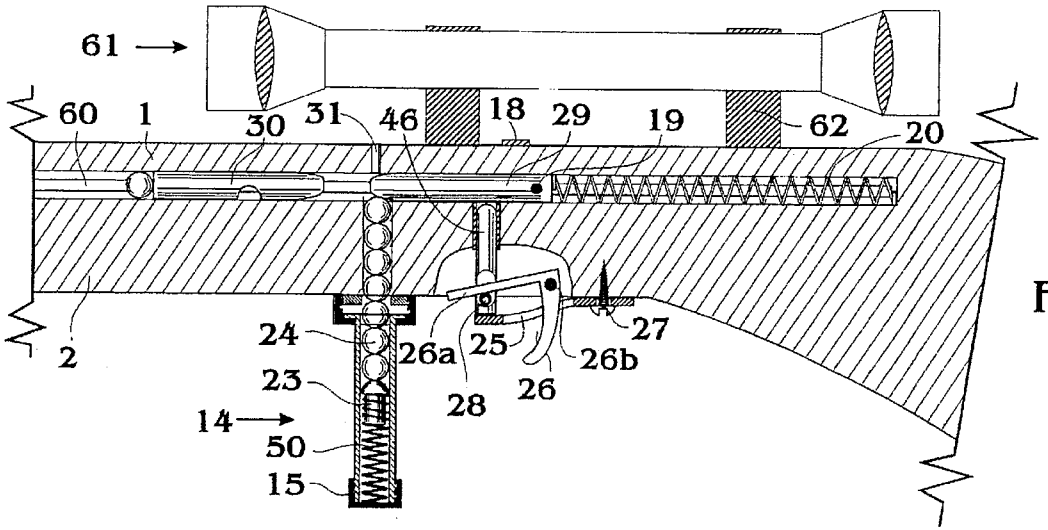

FIG. 8 shows the position of the trigger mechanism almost immediately after the trigger 26 has been moved back to fire the cross bow. The rotation of the trigger 26 around the pin **26*b* results in the arm 26*a* moving the cocking bolt 46 to release the free float bolt 29. The free float bolt 30 is shown in a position to the left of its cocked position as shown in FIG. 7. In the new position, the firing bolt 30 prevents any of the balls 24 from moving up and the free float bolt 29 has also moved left due to the expansion of the spring 20. FIG. 9 shows a time event subsequent to FIG. 8 and both the firing bolt 30 and free float bolt 29 have moved further to the left. The adjacent ends of the firing bolt 30 and free float bolt 29 are tapered so that there is a smooth transition as each moves over the balls 24. FIG. 10 is a short time of subsequent to FIG. 9 and shows that the spring 20 expands sufficiently to position the free float bolt 29 over the ball 24 to prevent the balls 24 from moving up. Pin 19 on the free float bolt 29 is stopped by bracket 18. Meanwhile, the firing bolt 30 continues to move left to propel the ball 36**.

During cocking, the sequence of events is substantially reversed and the firing bolt 30 is moved to the right of its position as shown in FIG. 10 past its positions shown in FIG. 9. The movement continues past FIG. 8 until its position shown in FIG. 7 which allows a new ball 36 to become engaged by the magnet 31 and for the trigger 26 to become engaged for firing.

Figure 11:
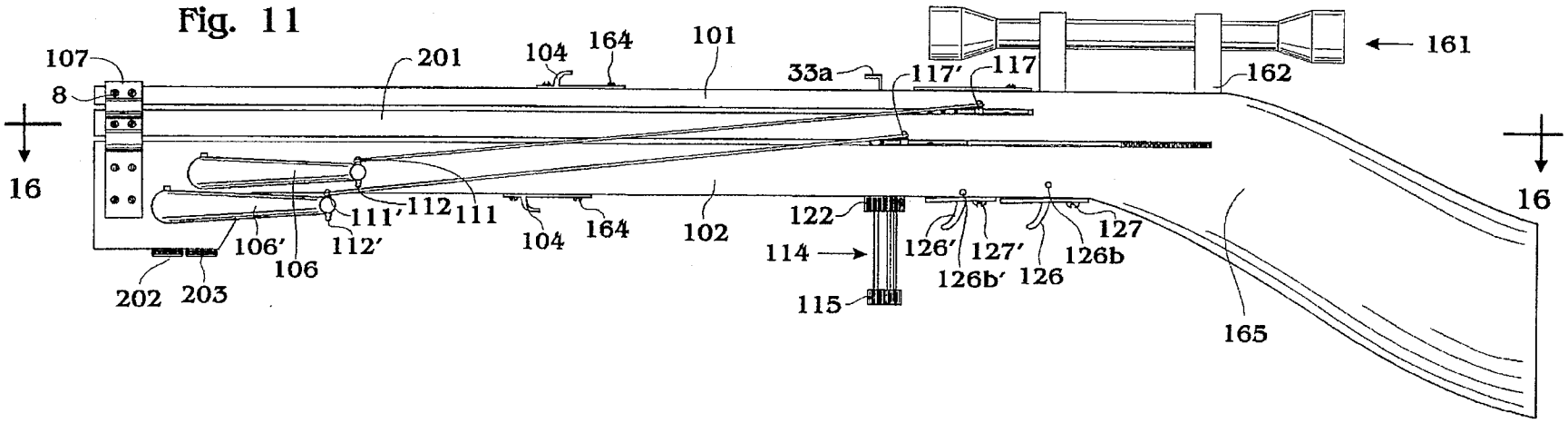
FIG. 11 a side elevational view of another embodiment of the cross bow according to the invention for a "double barrel" cross bow in its double cocked positions.
Figure 13:
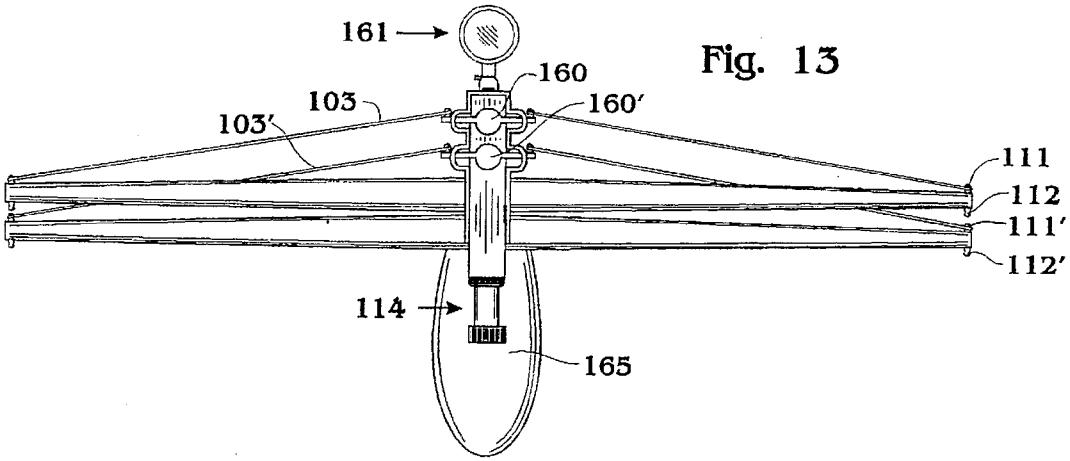
FIG. 13 is a front end elevation view of the cross bow shown in FIG. 11.

FIGS. 11–14 and 16–18 show other embodiments of the invention. FIG. 11 shows a side elevational view of a double barrel cross bow according to the invention with both barrels cocked. A channel 160 is defined by the top main beam 101 and middle main beam 201 while channel 160' is defined by the middle main beam 201 and bottom main beam 102. Cross bars 117 and 117' move in respective channels 160 and 160' for cocking and firing missiles. Muzzle bracket 7 stops the movement of the cross bars 117 and 117' and maintains the positions of the beams 101, 201 and 102 relative each. The muzzle bracket 7 is attached to the beams 101, 201 and 102 with pins 8.

Figure 14:
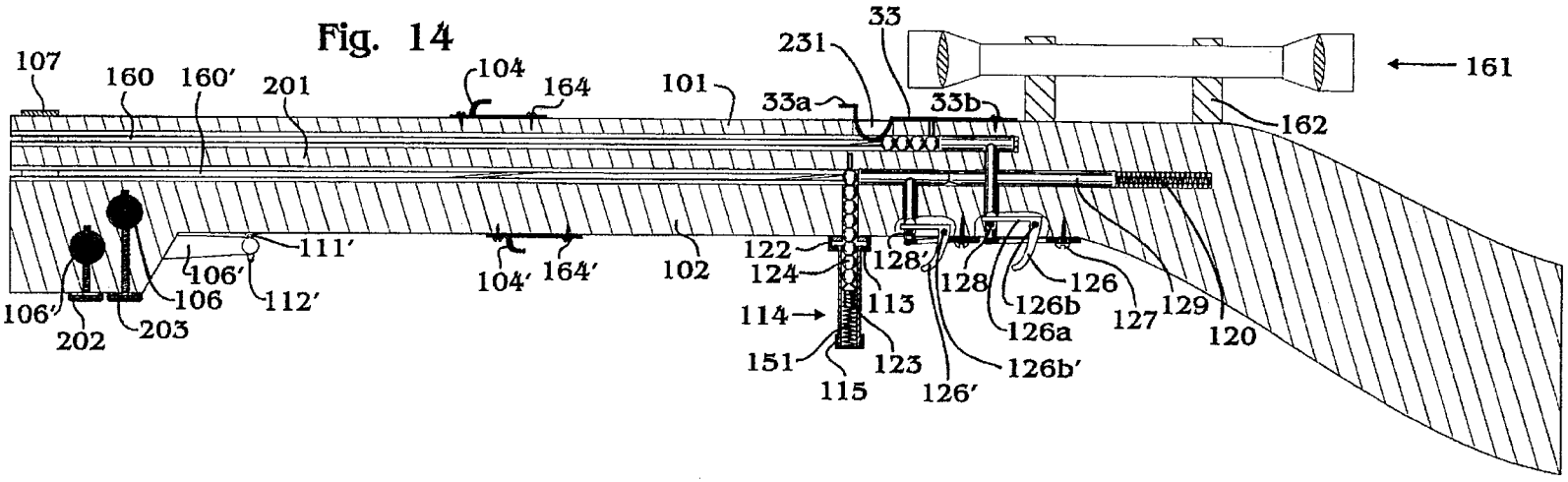
FIG. 14 is a view of the cross bow shown in FIG. 12 along the line 14—14.

Bow 106 is mounted on the bottom main beam 102 in a slot and maintained in the slot with bolt 203 as shown in FIG. 14. Similarly, bow 106' is mounted on the bottom main beam 102 in its own slot and maintained in the slot with bolt 202 as shown in FIG. 14.

Figure 12:
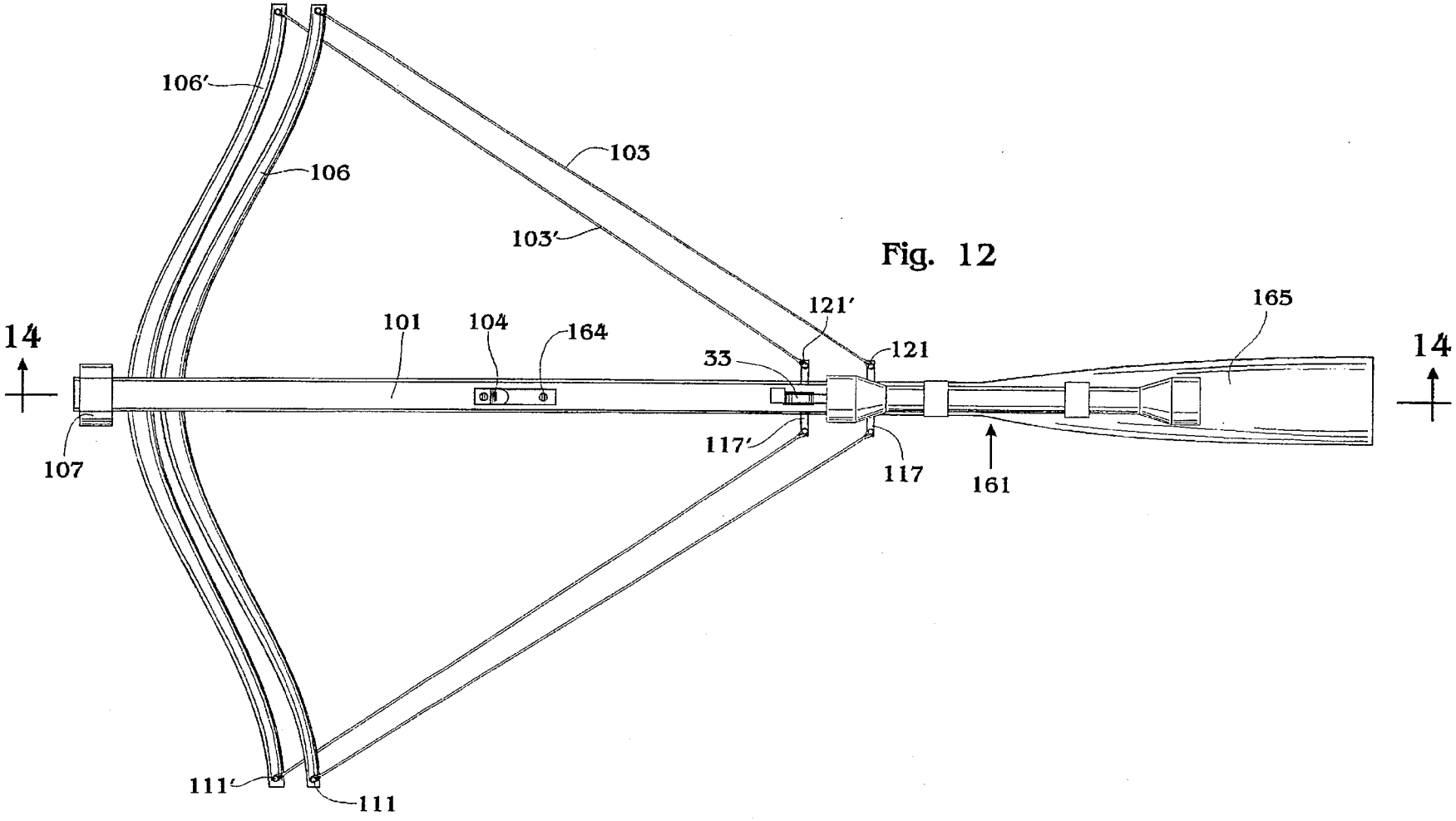
FIG. 12 is a top plan view of the cross bow shown in FIG. 11.

Main string 103 has two parts; one end of each part is attached to respective top bow horns 111. The other end are attached to respective cross bar horns 121 on cross bar 117. Similarly, main string 103' has two parts; one end of each part is attached to respective to bow horns 111' while the other ends are attached to respective cross bar horns 121' of cross bar 117' as shown in FIG. 12.

As in the embodiment shown in FIG. 1, each of the bows 106 and 106' can be cocked using a loading string (not shown). For the bow 106, the loading string would be attached to bottom bow horns 112 while for the bow 106', the loading string would be attached to the bottom bow horns 112'. Hooks 104 and 104', respectively, are used for cocking the bows 106 and 106'. The hooks 104 and 104' are attached to beams 101 and 102 respectively with screws 164 as shown in FIG. 11.

Butt 165 can have any suitable shape such as known in the prior art. A telescope 161 supported by brackets 162 can be used to improve accuracy.

Preferably, the bow 106' is cocked first and then the bow 106 is cocked. Either bow can be fired first. The cross bars 117 and 117' are shown in the cocked positions in FIGS. 11–13. FIGS. 14, 16, 17 and 18 show details of the trigger mechanism suitable for each of the "barrels" as well as feed systems for missiles.

Trigger 126 has an arm **126*a* and rotatably mounted on a pin 126*b*. Similarly, trigger 126' has an arm 126*a*' and is rotatably mounted on a pin 126*b*'. The arms 126*a* and 126*a*' are urged upward by respective pins 128 and 128' mounted on respective cocking bolts 246 and 146 which are being pressed by flat springs 125 and 125' respectively. The triggers 126 and 126' are positioned in openings of the respective flat springs 125 and 125'. The flat spring 125 is attached to the bottom main beam 102 with screw 127 while the flat spring 125' is attached to the bottom main beam 102 by screw 127'. The cocking bolts 146 and 246 move within sleeves 152 and 252**, respectively.

Figure 17:
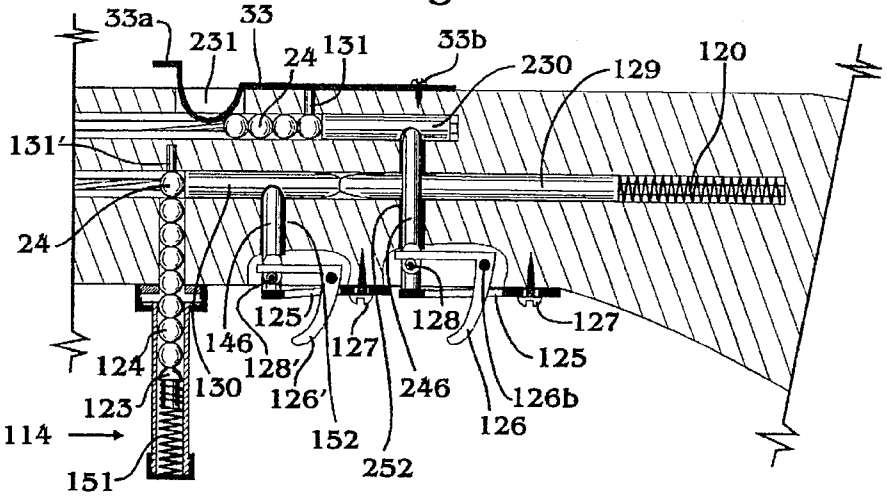
FIG. 17 is an enlarged fragmentary view of a portion of the cross bow shown in FIG. 14 in order to show the operation of the triggering system and the missile ball system.

Magazine 114 as shown in FIG. 17 is similar to the magazine 14. Balls 124 are urged upward by magazine bolt 123 which is attached to spring 151. The magazine 114 is screwed into threaded sleeve head 122 in the magazine locking cap 113 and magazine retainer cap 115 closes the bottom of the magazine 114. A magnet 131' holds a ball in its firing position.

Figure 18:
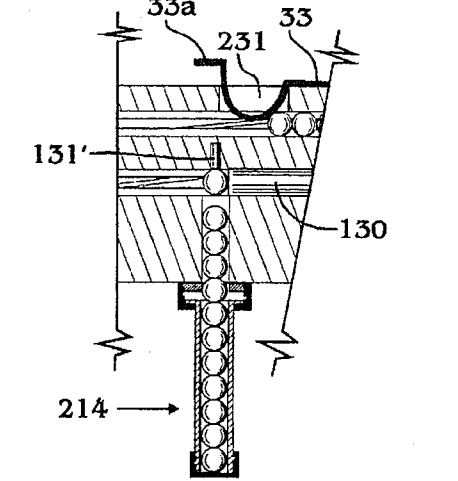
FIG. 18 is an enlarged fragmentary view of another feed system for the cross bow shown in FIG. 17.

FIG. 18 shows another magazine 214 similar to magazine 114 but without the magazine bolt 123 and the spring 151. The magazine 214 using a gravity feed system, rather than a spring driven feed system. For magazine 214, a ball 124 is positioned for firing by turning the cross bow upside down so that gravity causes the balls to move towards magnet 131'. Returning the cross bow right side up results in a ball 124 being held by the magnet 131' as shown in FIG. 18.

The feed system shown in FIG. 17 for the channel 160 of the top bow 106 is yet another embodiment. Pellet retaining spring 33 is mounted on the top main beam 101 as shown in FIG. 17. One end of the retaining spring 33 is attached to the top main beam 101 with screw **33*b* which allows tab 33*a* to be used to lift the other end of the retaining spring 33 out of the slot 231 so that missiles such as balls pellets and bullets can be loaded. Magnet 131 is positioned to hold a single ball in a firing position. as shown in FIG. 17, four balls 124** have been loaded to enable the cross bow to shoot all four balls at one time, thereby providing a scatter shot like a shotgun.

The firing system for the lower cross bow 160' is similar to the firing system in the single barrel embodiment shown in FIG. 1. Firing bolt 130 is cocked by moving the cross bar 117' back until cocking bolt 146 engages the slot in firing bolt 130 as shown in FIG. 17. When the trigger 126' is pulled back, the cocking bolt 146 is released and free float bolt 129 is pushed forward by spring 120 so that the free float 129 covers the feed for the magazine 114 to prevent an additional ball 124 from moving up to the magnet 131'.

The free bolt 129 is positioned in a slot defined in cocking bolt 246 so that the cocking bolt 246 stops the movement of the free bolt 129 after firing as in the case of pin 19 and bracket 18 for the embodiment shown in FIG. 1.

The triggering mechanism for the upper cross bow 106 is simple in its arrangement and operation. Firing bolt 230 is cocked by moving the cross bar 117 back until the firing bolt 230 engages the cocking bolt 246 as shown in FIG. 17. pulling trigger 126 back releases the firing bolt 230. No free floating bolt is needed in this arrangement. Thus, this is a less expensive embodiment to manufacture.

Figures 15, 16:
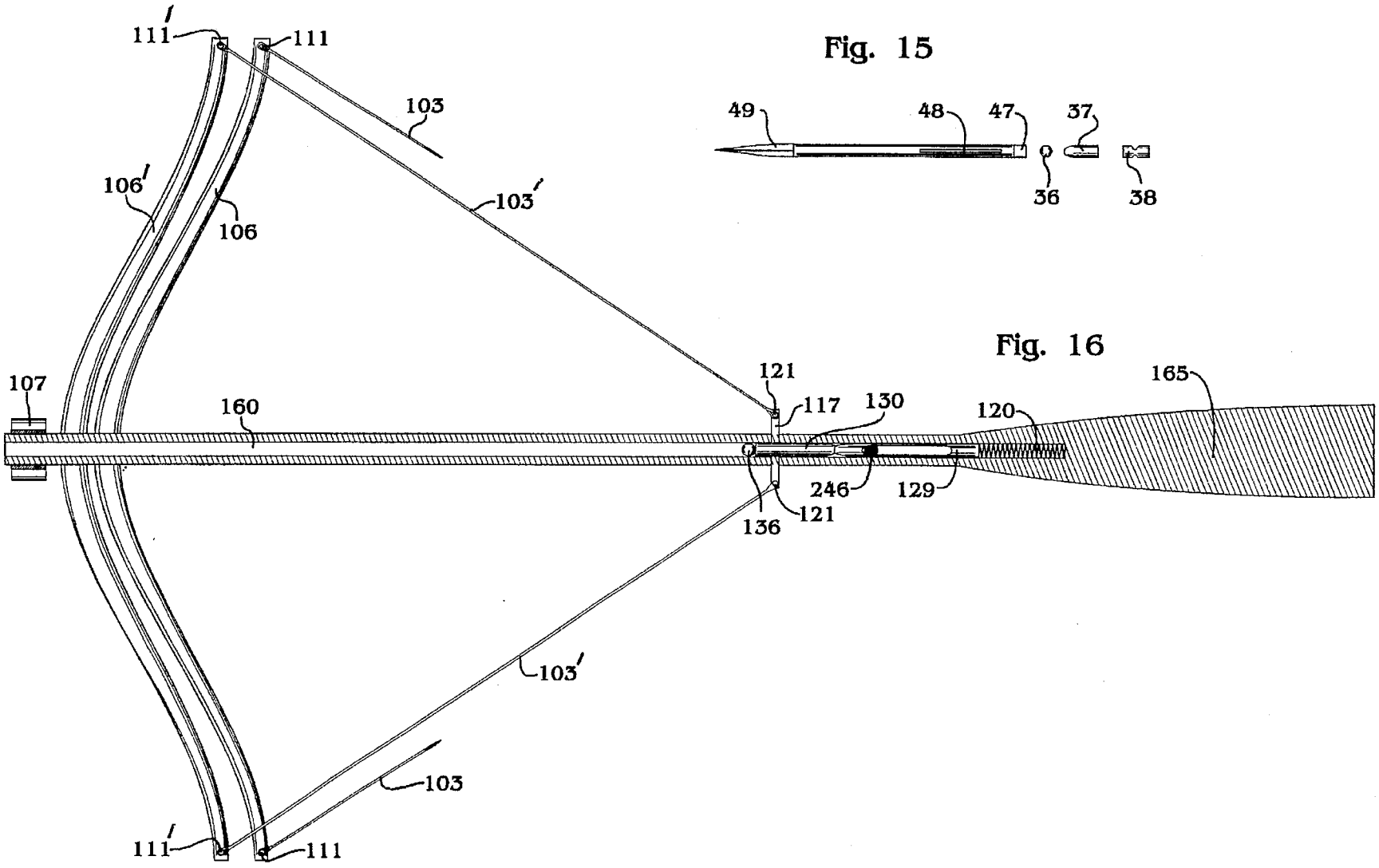
FIG. 15 shows several types of missiles which can be fired from the cross bow according to the invention.
FIG. 16 is a view of the cross bow shown in FIG. 11 along the line 16—16.

FIG. 15 shows several types of missiles which can be used with the cross bows according to the invention. The diameter of the missiles should be compatible with the dimensions of the bore of the cross bow such as channel 60. Preferably, the overall diameter of the missile should be slightly less than the diameter of the bore so that the missile moves freely, but not so that the missile can rattle. As indicated, the bore can be rifled to improve the accuracy of firing bullets. A single blade broad head arrow 49 includes parallel fletch 48 and an arrow butt cap 47 which is attracted by a magnet. The arrow 49 is loaded by sliding it down the firing channel such as channel 60 in FIG. 4. When the crossbow is cocked, the arrow 49 can be moved down the channel 60 until the arrow bolt cap 47 is attracted to the magnet 31. The loading of the ball 36 has been discussed already. Bullet 37 and air gun pellet 38 are particularly suited for firing from an arrangement shown from the upper barrel, channel 160, shown in FIG. 14. The retaining spring 33 prevents these objects from inadvertently falling down the channel 160.

FIGS. 19 to 24 show another embodiment of the invention showing a single shot bow for firing bullets, air gun pellets, or the like. The missile to be fired is loaded prior to arming or cocking the bow in contrast to conventional bows. Another feature of this embodiment is that the portion of the driving element for the missile does not contact the interior of the barrel so that rifling is not degraded at all by the driving element. Other important features will also become apparent.

Figure 19:
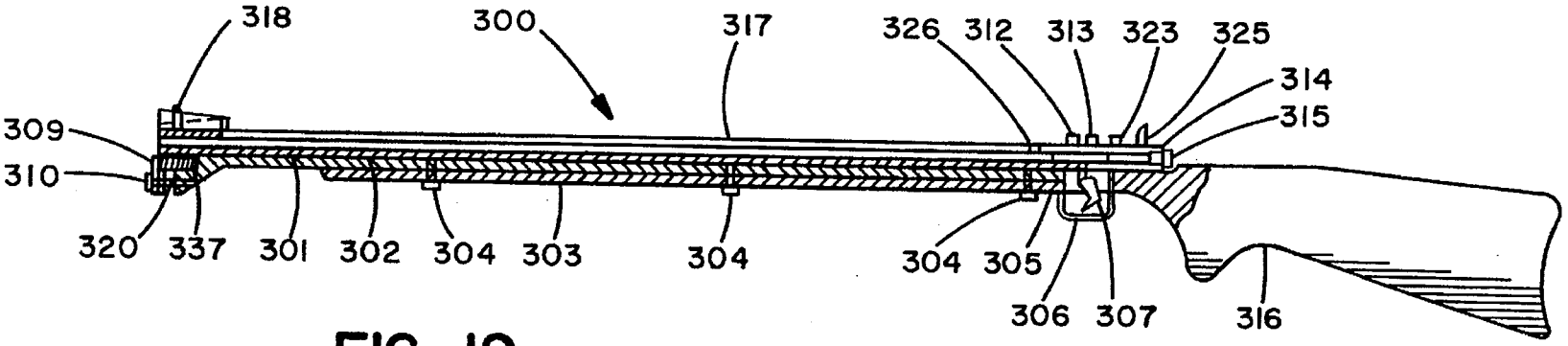
FIG. 19 is a side elevational view of another embodiment of the invention shown partially in section.
Figure 20:
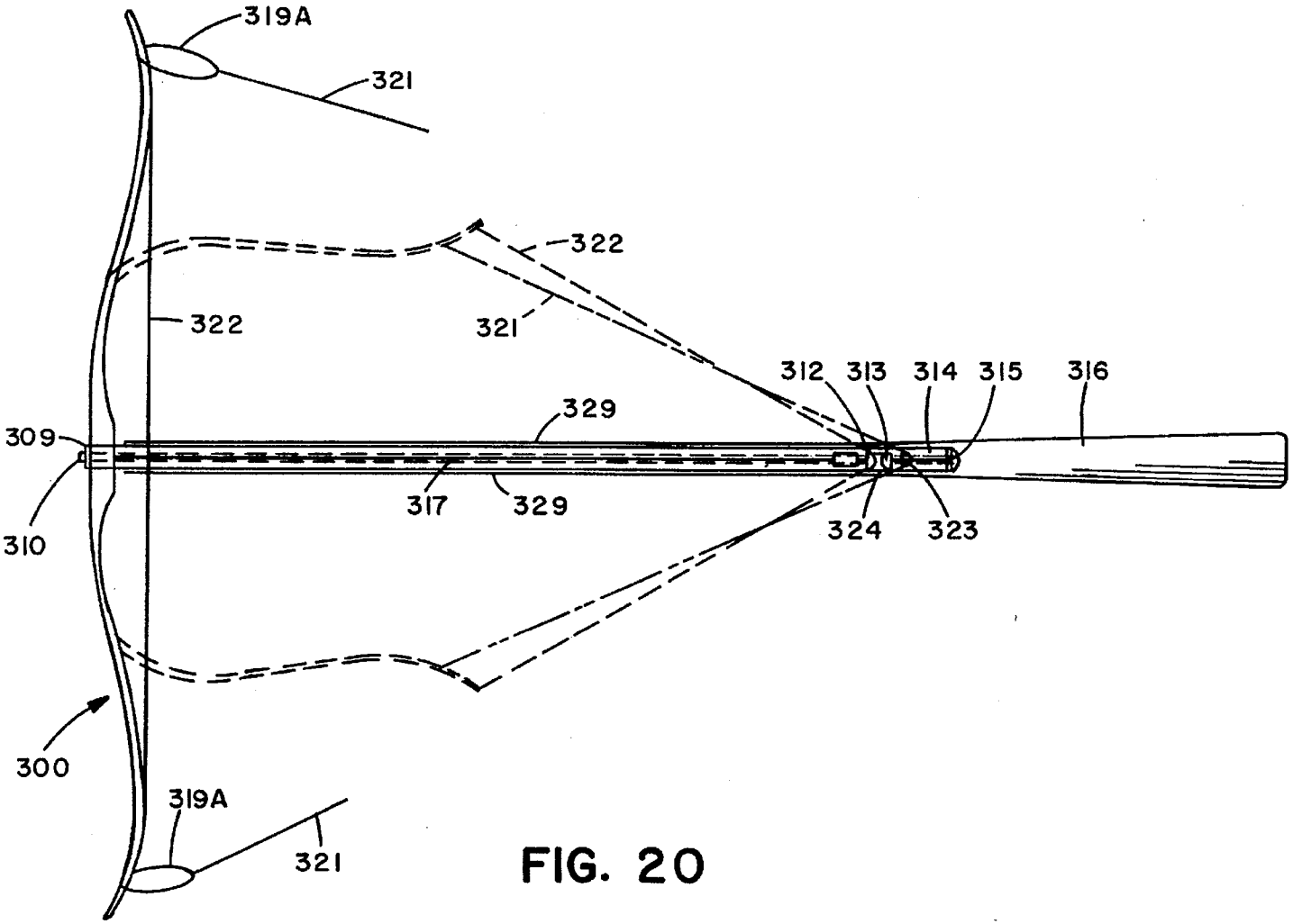
FIG. 20 is a top plan view of the embodiment shown in FIG. 19 with the cocked bow shown in dashed lines.
Figure 21:
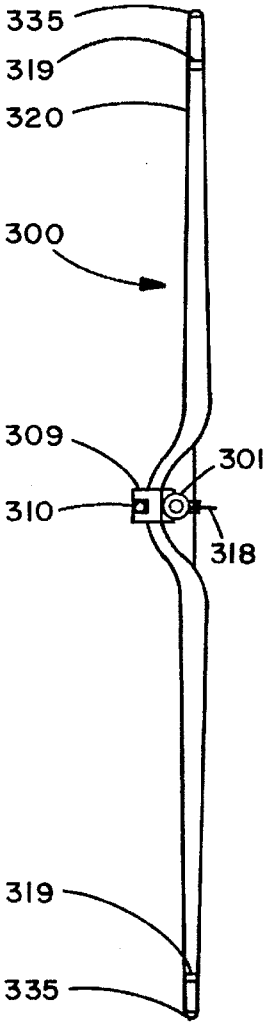
FIG. 21 is an end elevational view of the embodiment shown in FIG. 19.
Figure 23:
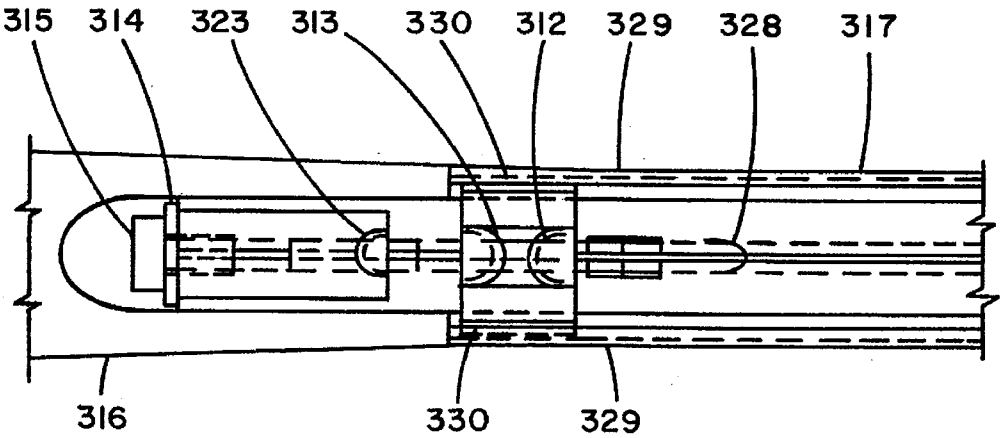
FIG. 23 is a top plan view of the portion shown in FIG. 21.
Figure 24:
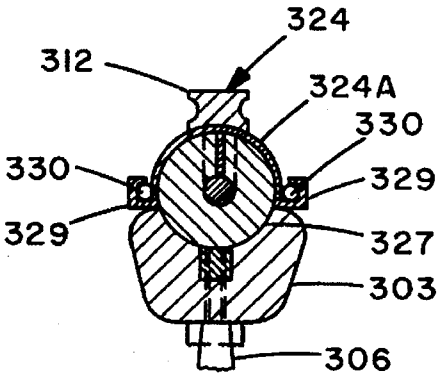
FIG. 24 is a sectional view of FIG. 22 along the lines of 24—24 with portions removed from the bow end to simplify the figure.

FIG. 19 shows a side elevational view of the cross bow 300 with portions removed to reveal interior components. A barrel 301 has a stiffening bar 302 attached to it to maintain the integrity of the structure of the barrel 301. The stiffening bar 302 can be attached to barrel 301 by bonding, or mechanically, or made integrally, or through other known techniques. Stock 316 is attached to the stiffening bar 302 at the front portion 303 with threaded bolts 304. Bow 320 as shown more clearly in FIGS. 20 and 21 is locked into anchor assembly bow slot 337 with flat plate 309 and threaded bolt 310. Front sight 318 is attached to the front of the cross bow 300 in a conventional manner. A firing slot 317 is defined along the length of the barrel 301.

Figure 22:
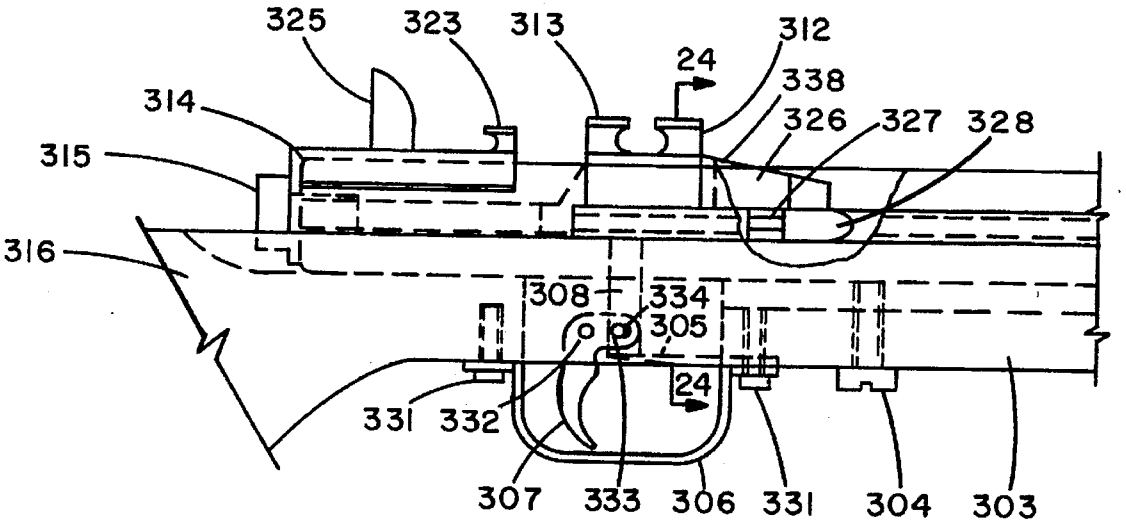
FIG. 22 is an enlarged fragmentary view of a portion of FIG. 19 with portions removed to show the interior.

A trigger guard 306 as shown more clearly in FIG. 22 is attached by threaded bolts 331 to the front portion 303. Trigger 307 is rotatably mounted by pin 332 and has a slot 333 engaging pin 334 which is mounted on triggering bolt 308. Movement of the trigger 307 back towards the stock 316 results in the generally linear movement of the trigger locking bolt 308 downward in a slot not shown. Flat spring 305 tends to maintain the trigger 307 forward so that the trigger locking bolt 308 is urged upward.

A removable bracket assembly 314 is attached with threaded bolt 315 and supports rear sight 325 and loading string hook 323. Firing bolt 324 can be seen clearly in FIGS. 22 and 24. The firing bolt 324 has front firing bolt hook 312 and rear firing bolt hook 313. Firing string 322 as shown in FIG. 20 can be engaged between the hooks 312 and 313, and loading string 321 can be engaged by hook 323. The firing bolt 324 has a firing bolt rider portion 338 extending downward into the slot 317 to firing bearing portion 327 which can contact and propel a missile such as bullet 328. The firing bolt 324 has a portion 324*a* connected to slides 330. The slides 330 engage and move in slide rails 329 which are mounted on the frontal portion 303 of the stock 316. As can be seen in FIG. 22, the firing bearing portion 327 has a smaller diameter than bore 336 so there is no contact, hence no mutual wear.

Loading of the bow 300 is by manually moving the firing bolt 324 back to expose loading port 326. The bullet 328 or air gun pellet is positioned through the port 326 and then the firing bolt 324 is moved fully forward to push the bullet 328 to be engaged by the rifling of the bore 336. The rifling prevents the bullet 328 from falling through the bore 336. As the firing bolt 324 is moved forward, the trigger locking bolt 308 is pressing upward and engages a locking slot which prevents further movement forward until the trigger 307 is released.

The firing string is attached to firing string horns 335 in a conventional manner. The bow 320 has hooks 319. These hooks 319 can be attached to the bow 320 or molded into the bow 320. The loading string 321 engages the hooks 319 with relatively large loops 319*a* to enable easy removal after the cross bow 300 has been cocked.

To use the cross bow 300, a bullet 338 is dropped into port 326 and the firing bolt 324 is moved forward so that the trigger locking bolt 308 becomes engaged in the firing bolt 324. Subsequently, loading string 321 is engaged into the hooks 319 and the bow 320 is bent so that the loading string 321 can be engaged into hook 323. Thereafter, firing string 322 is engaged into the space between the firing hooks 312 and 313, thereby allowing the loading string 322 to be removed easily.

Firing the cross bow 300 results in the firing bolt rider portion 338 moving along the slot 317 while slides 330 move in the rails 329.

One of the significant features of the embodiment shown in FIGS. 19–22 is a novel raised beam bow. The raised beam allows in-line string firing of the firing bolt 324 due to the firing string ends being at substantially the same level as the firing bolt notch between hooks 312 and 313. This arrangement prevents downward pressure on the firing bolt 324 on the slide portion of the barrel, as in prior art cross bows. Thus, there is relatively little pressure on the slides 330 in the rails 329 so more force is applied to the missile 328 due to reduced friction, resulting in very high speed as the missile leaves the cross bow.

There has been described novel crossbows. It is evident that those skilled in the art may now make numerous uses and modifications of and departures from the specific embodiments described herein without departing from the incentive concepts. Consequently, the invention is to be construed as embracing each and every feature and novel combination of features present or possessed by the crossbows herein disclosed and limited solely by the spirit and scope of the appended claims.

What is claimed is:

1. A cross bow operable for shooting missiles, comprising a bow including a main string;

a support engaged with and supporting said bow, said support including a wall defining an interior elongated barrel for missiles to be shot, a firing slot extending longitudinally along said wall allowing said barrel to communicate with the exterior of said support, a port defined in said support for positioning a missile to be shot into the barrel;

at least one rail extending longitudinally along the exterior of said support;

a firing means operable for propelling said missile, said firing means comprising a first portion for engaging said bow string, a second portion which extends through said firing slot, a third portion supported within said barrel by said second portion for engaging and pushing a said missile, and a fourth portion slidably engaged to said at least one rail, whereby said third portion is supported out of contact with said wall of said barrel thus reducing sliding resistance and wear;

triggering means engageable with said firing means for cocking and firing said cross bow.

* * * * *